US005373668A

United States Patent [19]

Shulman et al.

[11] Patent Number: 5,373,668

[45] Date of Patent: Dec. 20, 1994

[54] COTTAGE WITH REMOVABLE ROOF

[76] Inventors: Neil B. Shulman, 2272 Vistamont Dr.; Ulicer L. Cortes, 2224 Vistamont Dr., both of Decatur, Ga. 30033

[21] Appl. No.: 74,214

[22] Filed: Jun. 9, 1993

[51] Int. Cl.[5] ..... E04B 1/346

[52] U.S. Cl. ..... 52/66; 52/64

[58] Field of Search ..... 52/66, 64, 67; 296/100

[56] References Cited

U.S. PATENT DOCUMENTS

| | | | |
|---|---|---|---|
| 2,229,908 | 1/1941 | Wenneborg | 108/2 |
| 3,510,996 | 5/1970 | Popil | 52/64 |
| 3,815,299 | 6/1974 | Sörensen et al. | 52/66 |
| 3,837,629 | 5/1983 | Ahn | 52/66 |
| 4,004,778 | 1/1977 | Steinhagen | 254/142 |
| 4,038,788 | 8/1977 | Claessens | 52/2 |
| 4,175,361 | 11/1979 | Kumode | 52/66 |
| 4,682,449 | 7/1987 | Berger | 52/66 |
| 4,751,800 | 6/1988 | Kida et al. | 52/66 |

FOREIGN PATENT DOCUMENTS

| | | |
|---|---|---|
| 125099 | 1/1927 | France . |
| 69899 | 9/1915 | Germany . |
| 601208 | 8/1934 | Germany . |

OTHER PUBLICATIONS

"Rome of the Caesars", Leonardo B. Dal Maso-Bonechi-Edizioni <<Il Turismo>>, selected pages.

*Primary Examiner*—Carl D. Friedman
*Assistant Examiner*—Creighton Smith
*Attorney, Agent, or Firm*—Louis T. Isaf

[57] ABSTRACT

A cottage with a rear framed section that is adjacent to a front framed section, wherein the cottage functions to position the roof completely over the rear framed section or the front framed section, and in positions therebetween. A pair of winches are mounted adjacent to one another and act upon cables which are directed by pulleys to facilitate movement of the roof in opposite directions. A pair of track members are positioned along the top of the framed sections and a pair of track engaging members depend from the roof and engage the track members to facilitate movement of the roof. The track members define track channels and the track engaging members include a plurality of wheels that are rotatably attached to a roof engaging member. The wheels partially extend into the roof engaging member and depend partially therefrom to engage and travel within the track channels. The winches, pulleys, cables, track members, and track engaging members are designed to facilitate easy movement of the roof.

20 Claims, 3 Drawing Sheets

COTTAGE WITH REMOVABLE ROOF

BACKGROUND OF THE INVENTION

The present invention relates generally to the field of building structures, and, in its most preferred embodiments, to the field of building structures with movable roofs.

Structures with movable roofs or covers have been known of for quite some time. For example, such structures are generally disclosed in U.S. Pat. Nos. 2,229,908 issued to Wenneborg, 3,510,996 issued to Popil, 3,815,299 issued to Sorensen et al., 4,038,788 issued to Claessens, and 4,942,698 issued to Kumagai. The above identified patents clearly indicate that there is a need and use for structures with movable roofs or covers. For example, a building with a movable roof or cover allows the interior of the building to be subjected to direct sunlight or moonlight, and the fresh air of the environment exterior to the building. Such exposure of the interior of the building can, under certain circumstances, have a refreshing and cleansing affect. Such exposure allows for sunbathing or star and moon watching in the comfort of the environment within the building.

The structures with movable roofs and covers disclosed in the above-identified patents, while offering general advantages, have associated with them several potential problems. The above-identified patents do not disclose, for example, a cottage with a movable roof which is suitable for inexpensive construction and easy use. For example, at one extreme, U.S. Pat. No. 4,942,698 discloses an extremely complex structure that appears to be suitable only for very large scale and expensive application, such as at very large sport stadiums. At the other extreme is U.S. Pat. No. 2,229,908 which discloses a cottage with a movable roof that travels on tracks. While that which is disclosed in U.S. Pat. No. 2,229,908 appears to be simple in design, it lacks features that facilitate easy use. For example, only a rope that is to be pulled one way or the other is provided for controlling movement of the roof. It is thought that it would be very difficult to move a heavy roof by pulling a rope attached to it.

There is, therefore, a need in the industry for a cottage with a movable roof which solves these and other related, and unrelated, problems.

SUMMARY OF THE INVENTION

Briefly described, the present invention includes, in its most preferred embodiment, a building structure with a movable roof. The building structure (referred to hereafter as a cottage) includes a rear framed section that is adjacent to a front framed section. The cottage further includes a roof and functions so as to position the roof completely over the rear framed section or the front framed section, and in positions therebetween.

The rear framed section includes a wall that is opposite from the front framed section, and the front framed section includes a substructure that is opposite from the rear framed section. A pair of winches are mounted to the substructure. A cable extends upward from each winch and around a pulley mounted to the substructure. Each cable extends from that pulley toward the front gable of the roof. One cable is attached to the front gable while the other cable extends through the roof. The cable extending through the roof passes around a pulley mounted to the wall and then fixedly engages the rear gable of the roof. When one of the winches is operated the roof travels toward the wall. When the other winch is operated the roof travels toward the substructure. The winches, pulleys, and cables are positioned in a manner that seeks to facilitate easy movement of the roof.

A pair of track members are positioned along the tops of the framed sections, and a pair of track engaging members depend from the roof and engage the track members to facilitate movement of the roof. Each track member defines a track channel. Each track engaging member includes a plurality of wheels that are rotatably attached to a roof engaging member. The wheels partially extend into the roof engaging member and depend partially therefrom to engage and travel within a track channel. The track members and track engaging members are designed to facilitate easy movement of the roof.

It is therefore an object of the present invention to provide a cottage with a movable roof.

Another object of the present invention is to provide a cottage with a movable roof that includes a pair of conveniently and closely located winches that retrieve cables attached to the roof.

Yet another object of the present invention is to provide variously located pulleys that direct tensioned cables so as to facilitate movement of a roof.

Still another object of the present invention is to provide a system for moving a roof, wherein components of the system are centered relative to the roof to prevent cocking of the roof.

Still another object of the present invention is to provide a track assembly for facilitating easy movement of a roof.

Still another object of the present invention is to provide a track assembly that facilitates roof movement and seeks to precluding cocking of wheels that are part of the track assembly.

Still another object of the present invention is to provide a track assembly that facilitates roof movement and seeks to minimize airflow through the track assembly.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
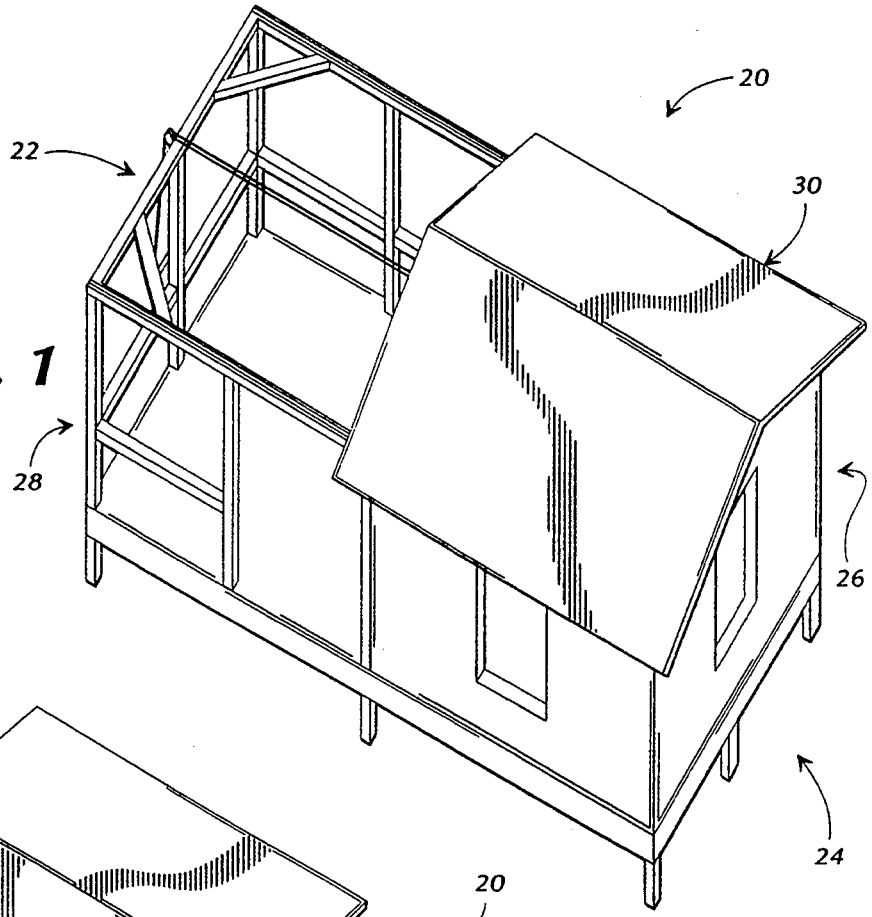
FIG. 1 is a rear, perspective view of a cottage with a movable roof, in accordance with the preferred embodiment of the present invention, with the roof is in a first position.
Figure 2:
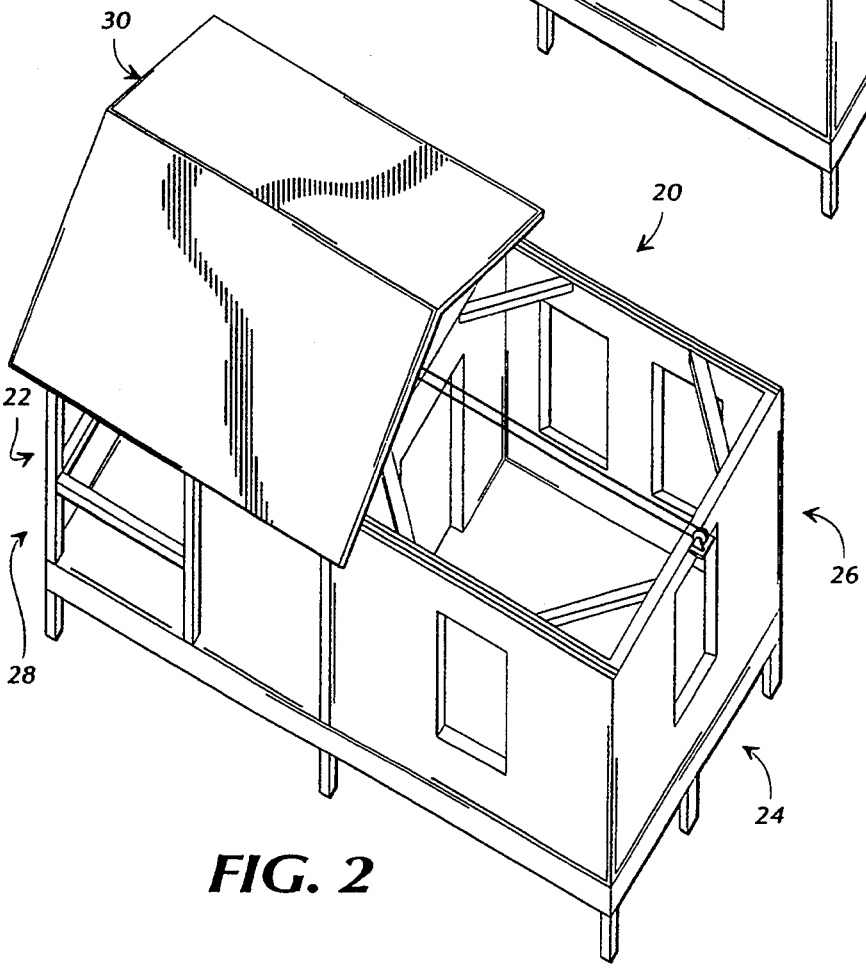
FIG. 2 is a rear, perspective view of the cottage of FIG. 1, with the roof in a second position.

Referring now in greater detail to the drawings, in which like numerals represent like components throughout the several views, FIG. 1 is a rear, perspective view of a building structure 20 (referred to hereafter as a cottage 20) in accordance with the preferred embodiment of the present invention. The cottage 20 includes a front 22, a rear 24, a rear framed section 26, a front framed section 28, and a roof 30 which, in FIG. 1, is above the rear framed section 26. As will be discussed in greater detail below, the cottage 20 functions so as to allow the roof 30 to be positioned completely over the rear framed section 26 or the front framed section 28, and in positions therebetween. For example, in FIG. 2, which is a rear, perspective view of the cottage 20 in accordance with the preferred embodiment of the present invention, the roof 30 is positioned over the front framed section 28.

Figure 3:
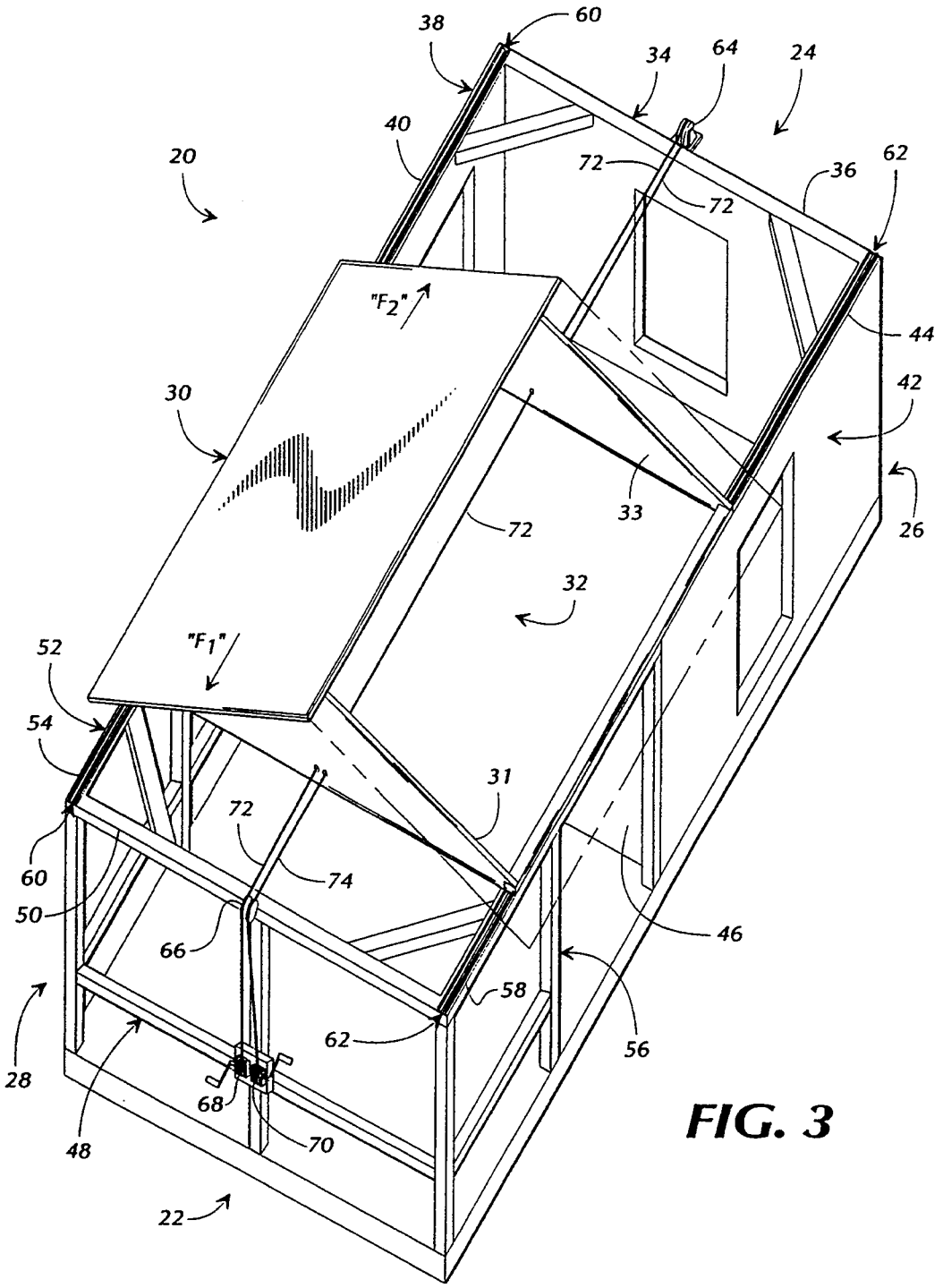
FIG. 3 is a front, perspective view of the cottage of FIG. 1, with the roof in a third position and partially cut-away.

FIG. 3 is a front, perspective view of the cottage 20 in accordance with the preferred embodiment of the present invention. In FIG. 3, the roof 30 is partially cut-away (as is indicated by broken lines) to show a roof cavity 32 that is defined within the roof 30. Also, the roof 30 is oriented in an intermediate position such that it is partially over the rear framed section 26 and the front framed section 28. The roof 30 includes a front gable 31 and a rear gable 33.

As shown in FIG. 3, the rear framed section 26 includes a first wall 34 that includes a top 36, a second wall 38 that includes a top 40, a third wall 42 that includes a top 44, and a fourth wall 46. Thus, in accordance with the preferred embodiment of the present invention, the rear framed section 26 is a "walled" section such as, for example, an enclosed room. The front framed section 26 includes a first substructure 48 that includes a top 50, a second substructure 52 that includes a top 54, and a third substructure 56 that includes a top 58. In accordance with the preferred embodiment of the present invention, the substructures 48,52,56 are "open" such that the front framed section 28 is an "open" section such as, for example, a porch. It should be understood, however, that variously constructed framed sections 26,28 are within the scope of the present invention.

In accordance with the preferred embodiment of the present invention, the cottage 20 further includes a first track member 60 that extends along the top 40 of the second wall 38 and the top 54 of the second substructure 52. A second track member 62 extends along the top 44 of the third wall 42 and the top 58 of the third substructure 56. The track members 60,62 function to aid in the movement of the roof 30 relative to the framed sections 26,28, as is discussed in detail below. A rear pulley 64 is attached to the top 36 of the first wall 34 midway between the second wall 38 and the third wall 42. A front pulley 66 is attached to the top 50 of the first substructure 48 midway between the second substructure 52 and the third substructure 56.

A first winch 68 and a second winch 70 are, in accordance with the preferred embodiment of the present invention, attached to the first substructure 48 below the front pulley 66 and at a position midway between the second substructure 52 and the third substructure 56. In accordance with the preferred embodiment of the present invention the winches 68,70 are manually operated. However, in accordance with alternate embodiments of the present invention, the winches 68,70 are motor-driven. Winches should be well understood by those reasonably skilled in the art. The first winch 68 and second winch 70 function to retrieve a first cable 72 and a second cable 74, respectively. The first cable 72 extends from the first winch 68; passes around the front pulley 66; passes through the front gable 31, roof cavity 32, and rear gable 33; then passes around the rear pulley 64; and then is securely attached to the roof 30 at the second gable 33. The second cable 74 extends from the second winch 70, passes around the front pulley 66, and is securely attached to the roof 30 at the first gable 31. In accordance with the preferred embodiments of the present invention, the cables 72,74 are attached to the roof 30 at positions that are midway between the track members 60,62.

Figure 4:
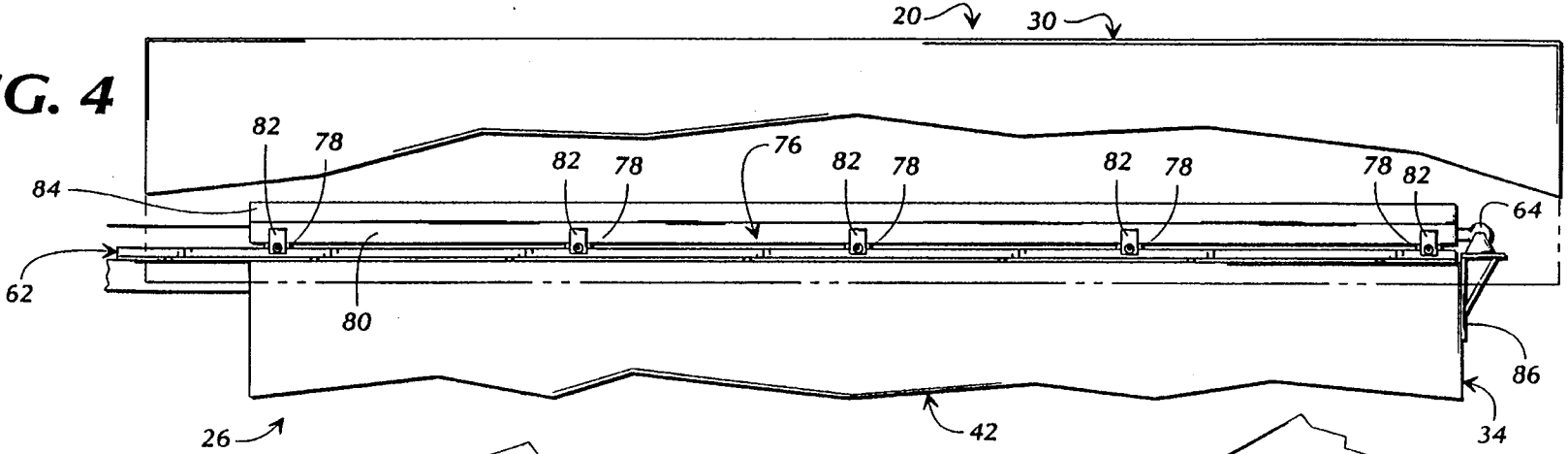
FIG. 4 is an isolated, side, cut-away view of selected portions of the cottage of FIG. 1.

FIG. 4 is an isolated, side, cut-away view of the cottage 20 with the roof 30 positioned over the rear framed section 26 (see FIG. 1). The perspective of FIG. 4 is such that the third wall 42 is seen. Portions of the roof 30 are cut-away (as is indicated by broken lines) so that the second track member 62 and elements associated therewith are in view. As shown in FIG. 4, the second track member 62 is engaged by a track engaging member 76. The second track member 62 and track engaging member 76 cooperate to aid in the movement of the roof 30. The track engaging member 76 comprises an assembly which includes a plurality of wheels 78 depending from and rotatably attached to a roof engaging member 80 by a plurality of wheel plates 82 (also see FIGS. 5 and 6). The roof engaging member 80 is attached to a lower roof member 84. An opposite side view of the cottage 20, with the roof 30 cut-away as it is in FIG. 4, would be the mirror image of FIG. 4. Also shown in FIG. 4 is a reinforcement plate 86 which, in accordance with the preferred embodiment of the present invention, reinforces the first wall 34 where the rear pulley 64 attaches thereto.

Figure 5:
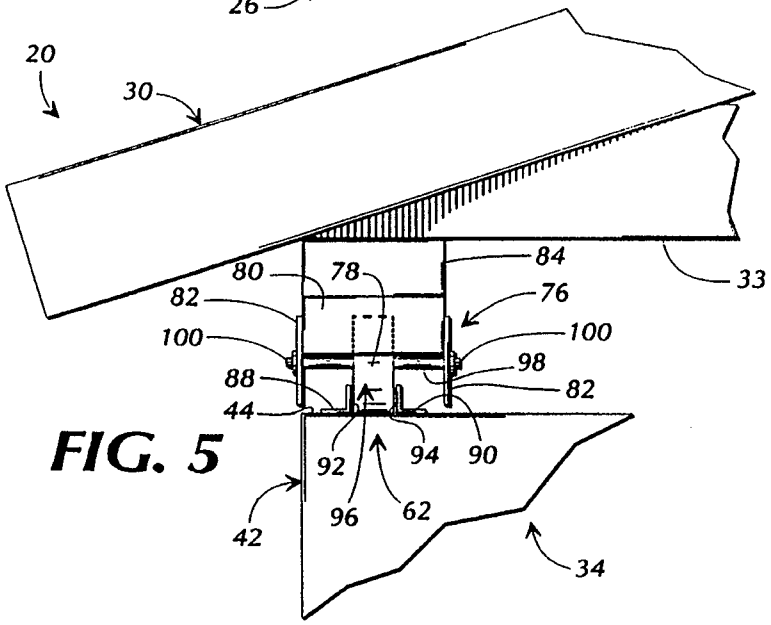
FIG. 5 is a rear, cut-away view of selected portions of the cottage of FIG. 1.

FIG. 5 is cut-away view of the rear 24 of the cottage 20 in accordance with the preferred embodiment of the present invention. Portions of the rear gable 33 (also see FIG. 3) are cut-away in FIG. 5 so that the track engaging member 76 and lower roof member 84 are clearly seen. In accordance with the preferred embodiment of the present invention, the gable 33 and roof 30 substantially hide the track engaging member 76 and lower roof member 84 from sight. In accordance with the preferred embodiment of the present invention, the second track member 62 includes a first railing 88 and a second railing 90. The railings 88,90 include a first planar surface 92 and a second planar surface 94, respectively, that are vertical and oriented opposite one another to define a track channel 96 therebetween. In accordance with the preferred embodiment of the present invention, an acceptable railing 88,90 is, for example, angle-iron. A wheel 78 is shown within the track channel 96 and extending into a wheel cavity 102 (not seen, see FIG. 6) defined within the roof engaging member 80 (as is indicated by broken lines). An axle 98 passes through each wheel 78 and includes ends 100. Each end 100 of each axle 98 is individually attached by a wheel plate 82 to the roof engaging member 80. The track engaging member 76 functions in a manner that allows the wheels 78 to roll within the track channel 96. The first track member 60 (see FIG. 3) is substantially similar to the second track member 62, and the first track member 60 is engaged by a track engaging member (not shown) that is substantially similar to the track engaging member 76.

Figure 6:
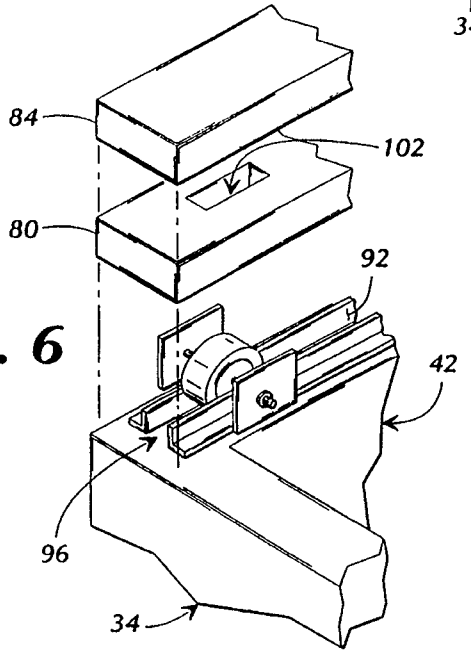
FIG. 6 is a perspective, cut-away, exploded view of selected portions of FIG. 5.

FIG. 6 is a perspective, cut-away, exploded view of portions of FIG. 5, in accordance with the preferred embodiment of the present invention. A wheel cavity 102, which is defined by the roof engaging member 80, is shown. While only one wheel cavity 102 is shown, the roof engaging member 80 defines a plurality of wheel cavities 102 such that each of the plurality of wheels 78 (FIG. 4) is partially disposed within a wheel cavity 102. The track channel 96 is also clearly shown in FIG. 6.

Referring back to FIGS. 1 and 2, in accordance with the preferred embodiment of the present invention, the cottage 20 functions to orient the roof 30 over either the rear framed section 26 (FIG. 1) or the front framed section 28 (FIG. 2). Referring to FIG. 3, the cottage 20 also functions to orient the roof 30 partially over both the rear framed section 26 and the front framed section 28.

Referring further to FIG. 3, the cottage 20 functions to orient the roof 30 over the front framed section 28 when the second cable 74 is retrieved by the second winch 70. When the second cable 74 is retrieved by the second winch 70, the second cable 74 is tensioned. By virtue of the front pulley 66, the tensioned second cable 74 exerts a force (represented by "$F_1$") on the roof 30. The force "$F_1$" is oriented toward the front 22 of the cottage 20. The track members 60,62 (see also FIGS. 4–6) and the track engaging members 76 (see FIGS. 4–6) function in response to the force "$F_1$" to cause the roof 30 to move toward the front 22 of the cottage 20. As the roof 30 moves toward the front 22 of the cottage, the first cable 72 is discharged from the first winch 68. The operation of the winches 68,70 should be understood by those reasonably skilled in the art.

The cottage 20 functions to orient the roof 30 over the rear framed section 26 when the first cable 72 is retrieved by the first winch 68. When the first cable 72 is retrieved by the first winch 68, the first cable 72 is tensioned. By virtue of the rear pulley 64 and front pulley 66, the tensioned first cable 72 exerts a force (represented by "$F_2$") on the roof 30. The force "$F_2$" is oriented toward the rear 24 of the cottage 20. The track members 60,62 (see also FIGS. 4–6) and the track engaging members 76 (see FIGS. 4–6) function in response to the force "$F_2$" to cause the roof 30 to move toward the rear 24 of the cottage 20. As the roof 30 moves toward the rear 24 of the cottage 20, the second cable 74 is discharged from the second winch 70. The operation of the winches 68,70 should be understood by those reasonably skilled in the art.

The present invention includes many important and inventive features, and some of these inventive features are, without limitation, briefly discussed hereafter. For example, the placement of the winches 68,70, pulleys 66,64, and cables 72,74 has an important impact on the operation of the cottage 20. For example, the winches 68,70 are placed such that they are easily accessible in one central location. The placement of the pulleys 64,66 facilitates the translation of the tensions developed in the cables 68,70 into oppositely oriented forces (i.e., forces "$F_1$" and "$F_2$"). Additionally, the placement of the pulleys 64,66 and the placement of the attachments of the cables 72,74 to the roof 30 function to maximize movement of the roof 30. These placements minimize any "cocking" of the roof 30 that might tend to cause the track members 60,62 (see also FIGS. 4–6) and the track engaging members 76 (see FIGS. 4–6) to bind.

Whereas this invention has been described in detail with particular reference to a preferred embodiment and alternate embodiments thereof, it will be understood that variations and modifications can be effected within the spirit and scope of the invention, as described herein before and as defined in the appended claims.

I claim:

1. A building structure comprising:

a first framed section;

a second framed section adjacent to said first framed section;

a roof structure;

a first cable attached to said roof structure;

a first pulley means mounted to said first frame section for directing said first cable;

a first retrieval means mounted at said second framed section for retrieving said first cable, wherein the retrieval of said first cable by said first retrieval means moves said roof structure over said first framed section;

a second cable attached to said roof structure; and a second retrieval means mounted at said second framed section for retrieving said second cable, wherein the retrieval of said second cable by said second retrieval means moves said roof structure over said second framed section.

2. The building structure of claim 1, wherein said roof structure is rigid.

3. The building structure of claim 1, wherein said first framed section includes, at least, a first side that is opposite from said second framed section, wherein said first pulley means is attached to said first side of said first framed section, wherein said first cable extends from said first retrieval means, passes around said first pulley means, and then fixedly engages said roof structure, whereby the retrieval of said first cable into said first retrieval means causes said roof structure to travel toward and become positioned over said first framed section.

4. The building structure of claim 3, wherein said roof structure defines a roof cavity therethrough, wherein said first cable extends from said first retrieval means, through said roof cavity, and then around said first pulley means.

5. The building structure of claim 1, wherein said first framed section includes, at least, a first side that is opposite from said second framed section and includes, at least, a top, wherein said second framed section includes, at least, a first side that is opposite from said first framed section and includes, at least, a top, wherein said first pulley means is positioned at said top of said first side of said first framed section, wherein said building structure further comprises a second pulley means at said top of said first side of said second framed section for directing said first cable and said second cable, wherein said roof structure is movably disposed between said first pulley means and said second pulley means, wherein said first cable extends from said first retrieval means toward and around said second pulley means, then toward and around said first pulley means, and then fixedly engages said roof structure, whereby the retrieval of said first cable by said first retrieval means moves said roof structure toward and into a position over said first framed section, and wherein said second cable extends from said second retrieval means toward and around said second pulley means, and then fixedly engages said roof structure, whereby the retrieval of said second cable by said second retrieval means moves said roof structure toward and into a position over said second framed section.

6. The building structure of claim 5, wherein said roof structure defines a roof cavity therethrough, and wherein said first cable extends from said second pulley means, through said roof cavity, and then around said first pulley means.

7. The building structure of claim 6, wherein said first retrieval means is a first manual winch, and wherein said second retrieval means is a second manual winch.

8. The building structure of claim 6, wherein said first retrieval means is a motor-driven winch, and wherein said second retrieval means is a motor-driven winch.

9. The building structure of claim 3, further comprising a roller track assembly disposed between said roof structure and said framed sections for aiding in movement of said roof structure.

10. The building structure of claim 9, wherein said roller track assembly includes, at least, a track member disposed above said first framed section and said second framed section, a plurality of wheels depending from said roof structure and engaging said track member, wherein said elongated track member and said plurality of wheels cooperate to allow said plurality of wheels to travel along said elongated track member.

11. The building structure of claim 10, wherein said elongated track member includes, at least, an elongated first planar surface that is vertically oriented, and a elongated second planar surface that is vertically oriented and disposed opposite to said first planar surface to define a track channel therebetween, wherein said plurality of wheels travel in said track channel between said first planar surface and said second planar surface.

12. A building structure comprising:

a walled section including, at least, a first wall including, at least, a top, a second wall extending from said first wall toward said open section, wherein said second wall includes, at least, a top, and a third wall extending from said first wall toward said open section, wherein said third wall is opposite from said second wall and includes, at least, a top;

an open section adjacent to said walled section, wherein said open section includes, at least, a first substructure including, at least, a top, a second substructure disposed between said first substructure and said walled section and including, at least, a top, and a third substructure disposed between said first substructure and said walled section, wherein said third substructure is opposite from said second substructure and includes, at least, a top;

a first track member attached to said top of said second wall and said top of said second substructure;

a second track-member attached to said top of said third wall and said top of said third substructure;

a rigid roof structure disposed above said first track member and said second track member, and defining a roof cavity therethrough;

a first track engaging member depending from said rigid roof structure and engaging said first track member;

a second track engaging member depending from said rigid roof structure and engaging said second track member;

a first pulley attached to said top of said first wall at a position between said second wall and said third wall;

a second pulley mounted to said top of said first substructure between said second substructure and said third substructure;

a first winch mounted to said first substructure below said second pulley and between said second substructure and said third substructure;

a second winch mounted to said first substructure below said second pulley and between said second substructure and said third substructure;

a first cable extending from said first winch, passing around said second pulley, then passing through said roof cavity, then passing around said first pulley means, and then fixedly engaging said roof structure; and a second cable extending from said second winch toward and around said second pulley, and then fixedly engaging said roof structure, whereby the retrieval of said first cable into said first winch causes said roof structure to travel toward and become positioned over said walled section, and whereby the retrieval of said second cable into said second winch moves said roof structure to travel toward and become positioned over said open section.

13. The building structure of claim 12, wherein said first track member includes, at least, a vertically oriented, elongated, first planar surface adjacent to said top of said second wall and said top of said second substructure, and a vertically oriented, elongated, second planar surface adjacent to said top of said second wall and said top of said second substructure, wherein said second planar surface is disposed opposite to said first planar surface to define a track channel therebetween, wherein said second track member includes, at least, a vertically oriented, elongated, first planar surface adjacent to said top of said top of said third wall and said top of said third substructure, and a vertically oriented, elongated, second planar surface adjacent to said top of said third wall and said top of said third substructure, wherein said second planar surface is disposed opposite to said first planar surface to define a track channel therebetween, wherein said first track engaging member includes, at least, a plurality of wheels that travel in said track channel of said first track member, wherein said second track engaging member includes, at least, a plurality of wheels that travel in said track channel of said second track member, and wherein said first track engaging member and said second track engaging member each further include, at least, an roof engaging member attached to said roof structure, wherein said roof engaging member defines a plurality of wheel cavities, and wherein each wheel of said plurality of wheels extends partially into a wheel cavity of said plurality of wheel cavities, and a plurality of wheel assemblies attaching said plurality of wheels to said roof engaging member, wherein each wheel assembly of said plurality of wheel assemblies includes, at least, an axle passing through a wheel of said plurality of wheels, wherein each axle includes, at least opposite ends, and plates attaching said ends of said axle to said roof engaging member.

14. A building structure comprising:

a first section and a second section, wherein said first section includes at least a first wall including at least a top, a second wall extending from said first wall toward said second section, wherein said second wall includes, at least, a top, and a third wall extending from said first wall toward said second section, wherein said third wall is opposite from said second wall and includes, at least, a top, and wherein said second section is adjacent to said first section and includes, at least, a first substructure including, at least, a top;

a roller track assembly disposed above said first section and said second section;

a rigid roof structure disposed above said roller track assembly, wherein said rigid roof structure defines a roof cavity therethrough;

a first cable attached to said rigid roof structure;

a first retrieval means mounted to said first substructure of said second section for retrieving said first cable; and a first pulley means for directing said first cable, wherein said first pulley means is attached to said top of said first wall of said first section at a position between said second wall and said third wall, wherein said first cable extends from said first retrieval means, extends through said roof cavity, passes around said first pulley means, and then fixedly engages said roof structure, and wherein the retrieval of said first cable into said first retrieval means causes said roof structure to travel toward and become positioned over said first section.

15. A building structure comprising:

a first section and a second section, wherein said first section includes, at least, a first wall including, at least, a top, a second wall extending from said first wall toward said second section, wherein said second wall includes, at least, a top, and a third wall extending from said first wall toward said second section, wherein said third wall is opposite from said second wall and includes, at least, a top, and wherein said second section is adjacent to said first section and includes, at least, a first substructure including, at least, a top;

a roller track assembly disposed above said first section and said second section;

a rigid roof structure disposed above said roller track assembly;

a first cable attached to said roof structure;

a first retrieval means mounted to said first substructure of said second section for retrieving said first cable;

a first pulley means for directing said first cable, wherein said first pulley means is attached to said first wall of said first section, wherein said first cable extends from said first retrieval means, passes around said first pulley means, and then fixedly engages said roof structure, and wherein the retrieval of said first cable into said first retrieval means causes said roof structure to travel toward and become positioned over said first section;

a second cable attached to said roof structure; and a second retrieval means mounted to said first substructure for retrieving said second cable, wherein the retrieval of said second cable by said second retrieval means moves said roof structure toward and to a position over said second section.

16. The building structure of claim 15, wherein said second section further includes, at least, a second substructure disposed between said first substructure and said first section and including, at least, a top, and a third substructure disposed between said first substructure and said first section, wherein said third substructure is opposite from said second substructure and includes, at least, a top, wherein said building structure further comprises a second pulley means for directing said first cable and said second cable, wherein said second pulley means is attached to said top of said first substructure between said second substructure and said third substructure, wherein said first retrieval means and said second retrieval means are disposed below said second pulley means between said second substructure and said third substructure, wherein said first pulley means is attached to said top of said first wall at a position between said second wall and said third wall, wherein said rigid roof structure defines a roof cavity therethrough, wherein said first cable extends from said first retrieval means, passes around said second pulley means, then passes through said roof cavity, then passes around said first pulley means, and then fixedly engages said roof structure, whereby the retrieval of said first cable into said first retrieval means causes said roof structure to travel toward and become positioned over said first section, and wherein said second cable extends from said second retrieval means toward and around said second pulley means, and then fixedly engages said roof structure, whereby the retrieval of said second cable by said second retrieval means moves said roof structure toward and into a position over said second section.

17. A building structure comprising:

a first section and a second section, wherein said first section includes, at least, a first wall including, at least, a top, a second wall extending from said first wall toward said second section, wherein said second wall includes, at least, a top, and a third wall extending from said first wall toward said second section, wherein said third wall is opposite from said second wall and includes, at least, a top, and wherein said second section is adjacent to said first section and includes, at least, a first substructure including, at least, a top;

a roller track assembly disposed above said first section and said second section;

wherein said roller track assembly includes, at least, a first track member attached to said top of said second wall and extending toward said second section, a second track member attached to said top of said third wall and extending toward said second section, a first track engaging member depending from said rigid roof structure and engaging said first track member, a second track engaging member depending from said rigid roof structure and engaging said second track member, wherein said first track member and said second track member each include, at least, an elongated horizontal surface, an elongated first planar surface adjacent to said elongated horizontal surface and vertically oriented, and an elongated second planar surface adjacent to said elongated horizontal surface and vertically oriented, wherein said second elongated planar surface is disposed opposite to said first planar surface to define a track channel therebetween, wherein said first track engaging member includes, at least, a plurality of wheels that travel in said track channel of said first track member, and wherein said second track engaging member includes, at least, a plurality of wheels that travel in said track channel of said second track member;

a rigid roof structure disposed above said roller track assembly;

a first cable attached to said roof structure;

a first retrieval means mounted to said first substructure of said second section for retrieving said first cable; and a first pulley means for directing said first cable, wherein said first pulley means is attached to said first wall of said first section, wherein said first cable extends from said first retrieval means, passes around said first pulley means, and then fixedly engages said roof structure, and wherein the retrieval of said first cable into said first retrieval means causes said roof structure to travel toward and become positioned over said first section.

18. The building structure of claim 17, wherein said first track engaging member and said second track engaging member each include, at least, an roof engaging member attached to said roof structure, wherein said roof engaging member defines a plurality of wheel cavities, wherein each wheel of said plurality of wheels extends partially into a wheel cavity of said plurality of wheel cavities, and a plurality of wheel assemblies for attaching said plurality of wheels to said roof engaging member, wherein each wheel assembly of said plurality of wheel assemblies includes, at least, an axle passing through a wheel of said plurality of wheels, wherein each axle includes, at least opposite ends, and plates attaching said ends of said axle to said roof engaging member.

19. A building structure comprising:

a first section;

a second section adjacent to said first section;

a roller track assembly disposed above said first section and said second section;

a rigid roof structure disposed above said roller track assembly, wherein said roof structure defines a roof cavity therethrough;

a first cable attached to said roof structure, wherein said first cable extends through said roof cavity;

a first retrieval means mounted to said second section for retrieving said first cable; and a first pulley means for directing said first cable, wherein said first pulley means is attached to said first section, wherein said first cable extends from said first retrieval means, passes around said first pulley means, and then fixedly engages said roof structure, and wherein the retrieval of said first cable into said first retrieval means causes said roof structure to travel toward and become positioned over said first section.

20. A method for moving the roof of a building structure with a movable roof, the method comprising the following steps:

attaching a first cable to a first side of a roof;

tensioning the first cable at a position adjacent to a second side of the roof which is opposite from the first side of the roof;

arranging the first cable so that when the first cable is tensioned at the position adjacent to the second side of the roof, the first cable is tensioned at the first side of the roof, whereby the roof moves;

attaching a second cable to the second side of the roof, and tensioning the second cable at a position adjacent to the second side of the roof, whereby the roof moves.

* * * * *

UNITED STATES PATENT AND TRADEMARK OFFICE

CERTIFICATE OF CORRECTION

PATENT NO. : 5,373,668

DATED : December 20, 1994

INVENTOR(S) : Neil B. Shulman; Ulicer L. Cortes

It is certified that error appears in the above-indentified patent and that said Letters Patent is hereby corrected as shown below:

On the title page, item [54] and column 1, line 2, the title should read --COTTAGE WITH MOVABLE ROOF--.

Signed and Sealed this

Twenty-first Day of March, 1995

*Attest:*

Bruce Lehman

BRUCE LEHMAN

*Attesting Officer*

*Commissioner of Patents and Trademarks*